US007446257B2

(12) United States Patent
Witthoft

(10) Patent No.: US 7,446,257 B2
(45) Date of Patent: Nov. 4, 2008

(54) COAXIAL CABLE WITH FINE WIRE INNER CONDUCTOR AND METHOD OF MANUFACTURE

(75) Inventor: Mark Witthoft, Lockport, IL (US)

(73) Assignee: Andrew LLC, Hickory, NC (US)

( * ) Notice: Subject to any disclaimer, the term of this patent is extended or adjusted under 35 U.S.C. 154(b) by 287 days.

(21) Appl. No.: 11/306,793

(22) Filed: Jan. 11, 2006

(65) Prior Publication Data

US 2007/0205008 A1 Sep. 6, 2007

(51) Int. Cl.
*H01B 7/00* (2006.01)

(52) U.S. Cl. ..... 174/28; 174/102 R

(58) Field of Classification Search ..... 174/36, 174/28, 102 R, 110 R, 110 F, 110 FC, 102 D, 174/110 PM, 120 R, 120 AR; 428/383, 461
See application file for complete search history.

(56) References Cited

U.S. PATENT DOCUMENTS

| | | | | |
|---|---|---|---|---|
| 3,173,990 | A * | 3/1965 | Lamons | 174/102 R |
| 4,107,354 | A | 8/1978 | Wilkenloh et al. | |
| 6,239,377 | B1 | 5/2001 | Nishikawa | |
| 6,756,538 | B1 | 6/2004 | Murga-Gonzalez et al. | |
| 2003/0011606 | A1 * | 1/2003 | Nonomura et al. | 345/547 |
| 2004/0007308 | A1 * | 1/2004 | Houston et al. | 156/54 |
| 2004/0151446 | A1 * | 8/2004 | Wyatt et al. | 385/100 |
| 2004/0222009 | A1 * | 11/2004 | Blew et al. | 174/110 F |

* cited by examiner

*Primary Examiner*—William H Mayo, III
(74) *Attorney, Agent, or Firm*—Babrock IP, PLLC

(57) ABSTRACT

A high impedance coaxial cable with a fine wire inner conductor and method of manufacture. An inner conductor less than 0.1 inches in diameter is coated with an adhesive resin. The coating having a thickness at least 50 percent of the inner conductor diameter. A foam dielectric surrounds the adhesive resin and an outer conductor surrounds the foam dielectric.

12 Claims, 2 Drawing Sheets

COAXIAL CABLE WITH FINE WIRE INNER CONDUCTOR AND METHOD OF MANUFACTURE

BACKGROUND OF THE INVENTION

Coaxial cables for high frequency signal transmission may be designed for specific operating impedances by adjusting the spacing between the inner conductor and the surrounding outer conductor. To design a coaxial cable for high impedance characteristic, the distance between the inner conductor and the outer conductor is increased and or a dielectric with a higher specific gravity is used. However, application of dielectric materials with higher specific gravities increases the materials cost, weight and signal loss characteristics of the cable. To minimize the overall diameter of a high impedance cable, where high signal power capacity is not a design parameter, the diameter of the inner conductor may be minimized down to that of a fine wire.

A coaxial cable with a fine wire inner conductor, surrounded by a foam dielectric that is covered by the outer conductor presents several manufacturing challenges. A fine wire inner conductor is very fragile. This makes it difficult to smoothly guide the inner conductor with the required precision through a traditional continuous coaxial cable manufacturing process.

Prior high impedance fine wire inner conductor coaxial cables have been observed with an unacceptably high number of longitudinal voids in the dielectric foam, proximate the fine wire inner conductor. These voids introduce variances to the dielectric value of the area between the inner and outer conductor, create a moisture/corrosion path within the cable and also allow the position of the inner conductor within the foam dielectric to vary. Together, these factors introduce a significant error between the designed and the measured characteristic impedance of the finished cable that may vary length to length of the cable.

A prior art coaxial cable with void(s) 5 around the fine wire inner conductor 10, for example as shown in FIG. 1, is difficult to prepare for interconnection because the exact inner conductor position is variable. Also, in contrast to a cable where the inner conductor 10 is fully supported by the foam dielectric 15, any pressure upon the inner conductor 10 during interconnection may cause it to bend and collapse into the void(s) 5, away from the cable end.

Competition within the coaxial cable industry has focused attention upon electrical characteristic uniformity, defect reduction and overall improved manufacturing quality control.

Therefore, it is an object of the invention to provide a coaxial cable and method of manufacture that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

The inventor has recognized the reason voids appear in prior high impedance fine wire inner conductor coaxial cables.

The foam dielectric area of a high impedance cable will be larger than in an otherwise similar low impedance cable. During the foam dielectric expansion step, the foam dielectric relies upon the thermal mass of the inner conductor to assist with the curing of the dielectric foam towards the center of the cable rather than just towards a cooling quench flowing around the exterior. Even if a traditional thin adhesive coating of an unexpanded plastic is present around the inner conductor, if insufficient inner conductor thermal mass is present to receive heat transfer from the dielectric foam, i.e. cool the core of the foam dielectric as it is expanded, the foam dielectric will pull away from the inner conductor, creating voids around the inner conductor.

The inventor's research has verified that applying a thick outer layer of adhesive resin around the fine wire inner conductor increases the thermal mass and improves the inner conductor mechanical characteristics during further manufacturing steps. The increased thermal mass and improved mechanical characteristics of the coated fine wire inner conductor results in a fine wire inner conductor coaxial cable with significant improvements in impedance characteristic uniformity and ease of use.

Figure 1:
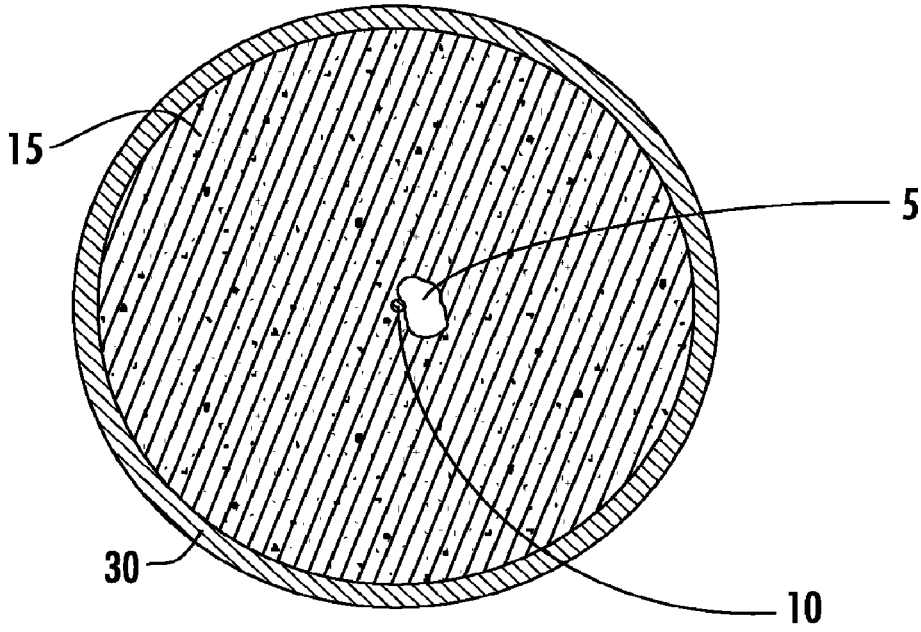
FIG. 1 (PRIOR ART)
FIG. 1 is a schematic representation of a prior art fine center conductor coaxial cable.
Figure 2:
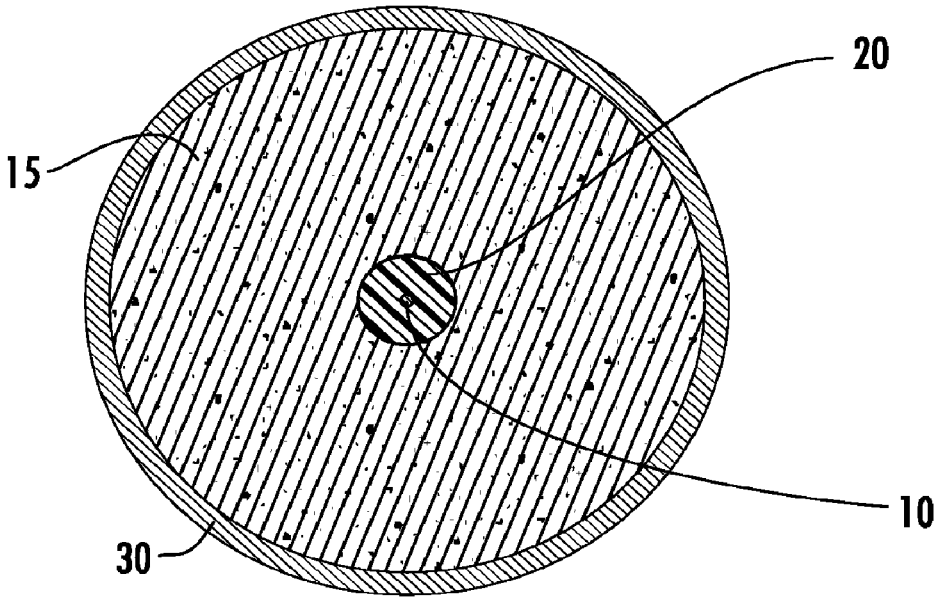
FIG. 2 is a schematic representation of a fine center conductor coaxial cable according to the invention.

As shown in FIG. 2, a first exemplary embodiment of the invention has a fine wire inner conductor 10 surrounded by a, for example, polyolefin adhesive resin coating 20 that has a thickness at least 50% of the inner conductor 10 diameter. The inner conductor 10 of the first exemplary embodiment shown in FIG. 2 has an inner conductor 10 diameter of 0.02 inches. Therefore, the adhesive resin coating 20 according to the invention should be at least 0.01 inches thick. In this embodiment, after the adhesive resin coating 20 is applied to the inner conductor 10, the resulting coated inner conductor 25 will have an overall exterior diameter of at least 0.04 inches.

The adhesive resin coating 20 is surrounded by a foam dielectric 15 which is surrounded by the outer conductor 30. In the exemplary embodiment, the foam dielectric 15 and adhesive resin coating 20 are polyolefin resins selected to have compatible molecular properties. The adhesive resin coating 20 also is selected to provide suitable adhesion to the inner conductor 10 as well as acceptable signal loss characteristics.

The fine wire inner conductor 10 of the first embodiment may have a steel core for improved tensile strength. Copper or other high conductivity metal electroplating may be applied to the steel core to protect it from corrosion and improve conductivity. An outer layer of tin may also be applied to simplify soldered connections to the inner conductor.

The outer conductor 30 may be a solid aluminum or copper material with or without corrugations, as desired. Alternatively, foil and or braided outer conductor(s) 30 may also be applied. If desired, a plastic outer protective sheath may be added.

Figure 3:
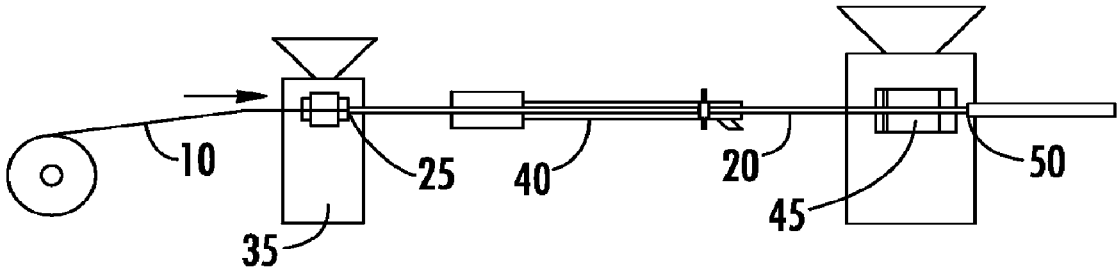
FIG. 3 is a schematic manufacturing process diagram.

During a continuous manufacturing process according to the invention, as shown in FIG. 3, the fine wire inner conductor 10 is delivered to a first extruder 35 that applies the adhesive resin coating 20 around the inner conductor 10 to a thickness at least 50% of the inner conductor 10 diameter. Passage through a cooling tube 40 or other cooling mechanism cools the conductor 10 and surrounding hot adhesive resin coating 20 (coated inner conductor 25). Where sufficient process space is available, the cooling mechanism may be formed as an extended transport path through open air.

Figure 4:
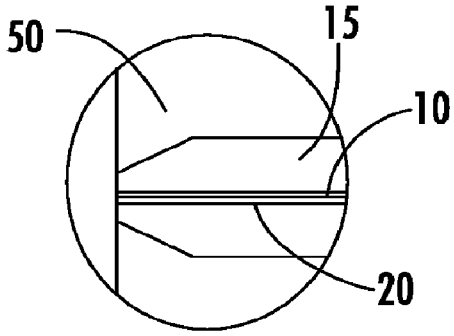
FIG. 4 is a close up of the quench area 50 of FIG. 3.

A second extruder 45 applies a foam dielectric resin layer to the coated inner conductor 25 that expands into the foam dielectric 15 upon exiting the second extruder 45. Expansion is aided by passage through a quench area 50, as shown in FIG. 4, until the foam dielectric 15 reaches its desired expansion. Because the inner conductor 10, coated by the adhesive resin coating 20, has a significantly higher thermal mass than prior high impedance fine wire inner conductor coaxial cables, the inner conductor 10 and adhesive resin coating 20 is able to draw heat from the hot foam dielectric 15 as it expands. Thereby, the formation of void(s) 5 between the coated inner conductor 25 and the foam dielectric 15 that are larger than a cell size of the dielectric foam are minimized and or eliminated. Any void(s) 5 present before application of the outer conductor 30 may be removed by the compression of the foam dielectric 15 during outer conductor 30 application.

The foam dielectric 15 coated inner conductor 25 may be cured for a desired period or passed directly to the outer conductor 30 application process (not shown). The desired outer conductor 30 may be applied, for example by seam welding a solid metal outer conductor 30, coaxial with the inner conductor 10, around the foam dielectric 15. Methods for applying outer conductor 30 to a foam dielectric 15 coated inner conductor 25 are well known in the art and as such are not described in further detail here.

To minimize material requirements, the adhesive resin coating 20 thickness may be adjusted until an acceptable level of void(s) 5 is obtained in the finished coaxial cable.

The invention has been demonstrated with respect to a first exemplary embodiment. One skilled in the art will appreciate that the cable design and manufacturing process herein is applicable to coaxial cables having a foam dielectric thickness corresponding to a characteristic impedance greater than 85 ohms and solid inner conductors of up to 0.1 inch in conductor diameter. For lower impedance and or thicker inner conductor cables, the thermal mass of the inner conductor 10, uncoated, should be sufficient to avoid the appearance of the void(s) 5 described herein, during curing of the foam dielectric 15 as long as the inner conductor 10 is not delivered to the second extruder 45 for foam dielectric 15 coating at an excessive temperature.

Although the manufacturing process is described as a continuous process, the process may be divided into several discrete sections with work in progress from each section stored before feeding the next section, without departing from the invention as claimed.

Table of Parts

| | |
|---|---|
| 5 | void |
| 10 | inner conductor |
| 15 | foam dielectric |
| 20 | adhesive resin coating |
| 25 | coated inner conductor |
| 30 | outer conductor |
| 35 | first extruder |
| 40 | cooling tube |
| 45 | second extruder |
| 50 | quench area |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A high impedance coaxial cable having a fine wire inner conductor, comprising:

an inner conductor less than 0.1 inches in diameter;

an adhesive resin surrounding the inner conductor having a thickness at least 50 percent of the inner conductor diameter;

a foam dielectric surrounding the adhesive resin; and an outer conductor surrounding the foam dielectric.

2. The coaxial cable of claim 1, wherein a characteristic impedance of the coaxial cable is greater than 85 ohms.

3. The coaxial cable of claim 1, wherein the outer conductor is one of solid copper and aluminum.

4. The coaxial cable of claim 1, wherein the inner conductor is copper coated steel.

5. The coaxial cable of claim 1, wherein the adhesive resin and foam dielectric are polyolefin.

6. A method for manufacturing a coaxial cable having a fine wire inner conductor, comprising the steps of:

coating an inner conductor less than 0.1 inches in diameter with an adhesive resin;

the adhesive resin surrounding the inner conductor having a thickness at least 50 percent of the inner conductor diameter;

surrounding the adhesive resin with a foam dielectric; and surrounding the foam dielectric with an outer conductor.

7. The method of claim 6, wherein the inner conductor is coated with the adhesive resin by passage through a first extruder.

8. The method of claim 6, wherein the adhesive resin is surrounded by the foam dielectric by passage through a second extruder.

9. The method of claim 6, wherein the foam dielectric and the adhesive resin are polyolefin.

10. The method of claim 6, wherein the coaxial cable is dimensioned to have a characteristic impedance greater than 85 ohms.

11. The method of claim 6, wherein the thermal mass of the inner conductor when coated with the adhesive resin is large enough to allow the foam dielectric to surround the adhesive resin without forming voids substantially greater than a cell size of the foam dielectric as the foam dielectric cures.

12. A method for manufacturing a coaxial cable having a fine wire inner conductor, comprising the steps of:

passing an inner conductor less than 0.1 inches in diameter through a first extruder to coat the inner conductor with an adhesive resin;

the adhesive resin surrounding the inner conductor having a thickness at least 50 percent of the inner conductor diameter;

cooling the inner conductor by passing it through a cooling mechanism;

passing the inner conductor through a second extruder to surround the adhesive resin with a dielectric foam;

passing the inner conductor through a quench area to expand the dielectric foam; and surrounding the foam dielectric with an outer conductor.

* * * * *

UNITED STATES PATENT AND TRADEMARK OFFICE

CERTIFICATE OF CORRECTION

PATENT NO. : 7,446,257 B2
APPLICATION NO. : 11/306793
DATED : November 4, 2008
INVENTOR(S) : Mark Witthoft It is certified that error appears in the above-identified patent and that said Letters Patent is hereby corrected as shown below:

On the Title Page, Item (74)
Front Page: (74) Attorney, agent or firm: should read - Babcock IP, PLLC -

Signed and Sealed this

Thirteenth Day of January, 2009

JON W. DUDAS
*Director of the United States Patent and Trademark Office*